United States Patent [19]

Mooney

[11] Patent Number: 4,651,893

[45] Date of Patent: Mar. 24, 1987

[54] LIQUID STORAGE TANK ASSEMBLY

[76] Inventor: Joseph R. Mooney, 33 Hawk St., New Orleans, La. 70124

[21] Appl. No.: 898,806

[22] Filed: Aug. 21, 1986

Related U.S. Application Data

[63] Continuation of Ser. No. 714,465, Mar. 21, 1985, abandoned, which is a continuation-in-part of Ser. No. 653,067, Sep. 21, 1984, abandoned.

[51] Int. Cl.[4] ..... B65D 25/18

[52] U.S. Cl. ..... 220/445; 220/453; 220/457; 220/469

[58] Field of Search ..... 220/445, 453, 457, 469

[56] References Cited

U.S. PATENT DOCUMENTS

| | | | |
|---|---|---|---|
| 1,235,128 | 7/1917 | Frank | 220/445 |
| 2,871,669 | 2/1959 | Mann et al. | 220/445 X |
| 3,516,568 | 6/1970 | Fish | 220/457 X |
| 3,848,765 | 11/1974 | Dürkop | 220/469 X |
| 3,902,941 | 9/1975 | Withers | 220/453 X |
| 3,941,272 | 3/1976 | McLaughlin | 220/453 X |

*Primary Examiner*—Steven M. Pollard
*Attorney, Agent, or Firm*—Walker & McKenzie

[57] ABSTRACT

An underground liquid storage tank assembly including an inner vessel, preferably of steel or other strong, economical material; a seamless outer containment shell, preferably of strong corrosion resistant material such as fiberglass reinforced plastic; and an intermediate spacer member between the inner vessel and outer containment shell to hold the two members rigidly together and for allowing the free passage inside the outer containment shell of any liquid that might leak from the inner vessel. Structure is preferably provided inside the outer containment shell to allow the presence of leakage from the inner vessel to be detected.

8 Claims, 24 Drawing Figures

LIQUID STORAGE TANK ASSEMBLY

CROSS REFERENCE TO RELATED APPLICATION

This is a continuation of my application, Ser. No. 714,465, filed Mar. 21, 1985, now abandoned, entitled "Liquid Storage Tank Assembly" which is a a continuation-in-part of my application, Ser. No. 653,067, filed Sept. 21, 1984, entitled "Underground Liquid Storage Tank Assembly",now abandoned.

BACKGROUND OF THE INVENTION

1. Field of the Invention

The present invention relates in general to underground liquid storage tanks and to methods for constructing such tanks.

2. Description of the Prior Art

The following patents were found during a preliminary patentability search directed to class 220, subclasses 445, 447, 448 and 3: U.S. Pat. No. 3,412,891; U.S. Pat. No. 3,472,632; U.S. Pat. No. 3,661,294; U.S. Pat. No. 3,667,423; U.S. Pat. No. 3,851,611; and U.S. Pat. No. 4,374,478. None of the above patents disclose or suggest the present invention.

There are a number of underground tank storage systems now in use, some of which are as follows:

a. The oldest, simplist, and most numerous system in current service is the simple steel tank produced by a number of steel tank manufacturers throughout the United States (and throughout the world). These tanks are usually coated with a material which will tend to protect, to some extent, the tank from outside corrosion due to electrolysis, chemical action, ect. A commonly used coating is coal-tar epoxy. It is somewhat effective, but most manufacturers will not guarantee the tank against outside corrosion for more than a year.

b. Another system uses plastic tanks, usually well known "fiberglass" tank, made of some form of epoxy and reinforced chopped glass fibers. These tanks are very effective against outside corrosion as well as internal corrosion which might occur from chemical action. This tank is fairly high in cost, and special installation procedures, because of the lack of strength of the tank as compared with steel, result in additional installation costs. Spillages have resulted because of improper installation causing extreme stresses and cracking of the tank shell. Such failures would not normally occur with the stronger steel tank.

c. A modified system uses steel tanks with a protective plastic coating. The protective coating is usually FRP (fiberglass reinforced plastic), basically the same material used as in the plastic tanks discussed above. This tank is obviously more costly than the simple steel tanks. Possible disadvantages are that, should the fiberglass coating be chipped away from the steel during transport or during the installation, all of the external corrosive factors will be constructed at the one exposed area of steel. This defect would not be detectable in a pressure test of the tank after installation, and would only show up when, and if, the tank should finally become a "leaker".

d. Another system consists of double-wall steel tanks with standard coating on the exterior tank (the standard coating, that is, coal-tar epoxy coating, or equal). The double-wall steel tank is, in effect, a tank within a tank. The inner and outer shells are held together rigidly with welded members, with free passageways for any leakage that might come from the inner tank and leak into the outer shell. This construction normally includes openings in the top ends of the outer shell, usually fitted with 2" pipe, or larger pipe, so that hydrocarbon detector probes may be inserted into the outer shell, at or near the bottom. Leakage from the basic storage tank, that is, the inner tank, is trapped inside the outer shell so that it can be detected. Some of the disadvantages: This is costly construction; the outer shell may corrode, and product may leak out through it, and/or water may come into it from the surrounding excavation. One advantage is that the inner storage tank, and the outer shell may be tested separately to determine their integrity; this does not always hold true, but it does at the time of initial installation.

e. A modified version uses a double-wall steel system, similar to that discussed above but with a corrosion resistant fiberglass-reinforced-plastic or other exterior coating.

This is an excellent system, very strong structurally, corrosion resistant, with good leak-trapping capabilities, but extremely expensive.

f. A similar system consists of a double-wall reinforced fiberglass-plastic (or other plastic materials) tanks. The fiberglass tank manufacturers have come out with their own version of the "tank within a tank". It is a good system, but extremely expensive. The system has far less strength than the double-wall steel system, installation is expensive, and there is always the concern about future cracking due to faulty installation, or due to "flexing" caused by change in elevation of product inside the tank and by change in elevation of exterior water tables.

g. Another system has been referred to as the "Tank in a Bag". This consists of a steel tank encased in an outer cover of plastic material. One manufacturer uses a rather soft plastic which is slipped over the inner steel tank and then sealed, usually by heat-welding.

Another manufacturer uses a more rigid plastic outer shell, which is usually factory installed, and the plastic outer shell joints are also heat-welded. Field installation usually requires some additional heat-welding. Some disadvantages are that the outer cover is not rigidly separated from, nor is it rigidly attached to, the inner steel tank. Thus, it is not an integral unit, and does not have the overall strength of some of the other systems. The heat-welded joints could be a possible source of future trouble, if there is any sub-standard quality of welding.

h. In some areas double-wall containment is achieved by installing the basic storage tank in "vault", usually made of concrete. Not only is this extremely costly, but if the vault should fail, for example should crack, not only would it not serve the purpose of containing leakage, but it would also admit ground water.

i. Another system positions the complete tank, piping and island dispenser units in a large excavation lined with a plastic material. This is obviously a very expensive system. The complete excavation for the tank and piping system is lined with a plastic material. The plastic usually comes in sheets or strips. These sheets or strips must be sealed together in the field, usually by heat-welding, in order to assure that there will be no passage of liquid, either in or out, through the plastic.

The system is very expensive. It is particularly difficult to install in areas which have a high water-table. Sensor "wells", usually 4" to 6" in diameter, are placed at strategic locations inside the excavation liner for the purpose of detecting the presence of hydrocarbons. False indications of leaks can occur when there are product spills, including spillage due to "overfills".

In some "double-wall" tank systems, provisions are made for connecting to "double-wall piping". The inner tank is connected to the basic pump and vent piping. The outer shell is connected to larger piping which surrounds the basic system piping. Thus if there should be a leak in a pump discharge line, or in a vent pipe, liquid would escape, and would drain back through the outer pipe into the outer shell of the double-wall tank system so that they might be detected by the hydrocarbon detector. Some users prefer not to use the double-wall piping, but prefer to use "Line Leak Detectors" for detecting leaks in the pump piping. Pump piping leakage is of particular significance because of potentially large leaks due to the relatively high pressures developed by the pumping equipment. Vent line leaks are not as significant, but must, of course, be considered when designing a system.

None of the above systems disclose or suggest the present invention.

SUMMARY OF THE INVENTION

The present invention is directed toward providing an improved liquid storage tank assembly and method of construction. The concept of the present invention is to provide a completely rigid double-wall tank, or tank-within-a-tank, assembly comprising, in combination, an inner tank; an outer tank; and spacer means for being positioned between and securely joining the inner and outer tanks and for defining a passageway between the inner and outer tank to allow any leakage of fluid from the inner tank to pass therethrough.

The present invention includes the use of an approved-type steel tank (usually approved by Underwriter's Laboratories or Factory Mutual, and National Fire Protection Association) of the type commonly used in service stations, having substantial structural strength, and an exterior tank enclosing the steel tank, the exterior tank to be of a corrosion-resistant material (such as, Fiberglass Reinforced Plastic). The principal objective of the present invention is to have the corrosion-resistant exterior tank protect the steel tank (which is more vulnerable to corrosion from soil chemicals and other factors) and thus prevent leakage of product from the interior steel tank. Another objective is to trap any leakage which might occur (from the interior tank) in the space between the two tank walls and to detect its presence by means of sensing devices located at each end of the tank system, between the two walls. Detection of leakage from the interior tank will thus enable the owner of the tank to take corrective action (repair or replacement) and thus prevent leakage into the earth, or groundwater, or etc.

A major design feature of the present invention is the structural integrity of the assembly. The interior and exterior tanks are rigidly connected by spacer means between the two walls, the spacer means being firmly attached to both walls. Previous designs by other persons, using a combination of an interior steel tank and an exterior plastic cover (sometimes called a "bag") are not, in effect, a single structural entity, having the strength and rigidity of steel, as does the present invention.

It has been estimated that there may be as many as one million, or more underground tanks in the United States being used for liquid storage. Of these, by far the greatest number are in gasoline service stations. Most of these tanks, particularly the older ones, are made of steel, and many of these (some estimates run well over 100,000) are leaking due to the fact that corrosion of the steel has taken place.

Many of the major oil companies have replacement programs which involve the removal of the older tanks on a regular basis, a certain percentage a year, and replacement with new tanks made of corrosion-resistant materials, or which are cathodic-protected or enclosed in vaults or other types of enclosures which would trap any leakage which might occur. The primary interest of the oil companies seems to be in protecting the environment (sources of drinking water, etc.) rather than the loss of the valuable product which leaks away. Both factors are obviously very important.

The National Fire Protection Association (NFPA) defines a tank "leaker" as one which is losing 1.2 gallons per day or more. Obviously, a tank which is losing less than that, for example, 1 gallon per day, or 365 gallons per year is, in fact, a "leaker". But the NFPA is aware of the difficulty of detecting relatively small leakage losses from large tanks. The NFPA has taken into consideration the state of the art of underground tank leak test technology. In a one hour test of a 10,000 gallon underground tank, for example, a 1.2 gallon per day leak, or a 0.05 gallon per hour leak, is a search for a loss of one part in 200,000. The present inventor is of the opinion that the standard should be tighter, for example, 0.03 gallon per hour (0.072 gallon per day), because he feels, that present underground tank leak detector technology (see, e.g., Mooney, U.S. Pat. Nos. 4,186,591; 4,386,525 and 4,404,842) is capable of detecting leaks in the range of 0.03 gallon per hour.

In one embodiment of the present invention, the spacer means is defined by a plurality of intermediate spacer members with each spacer member having a first surface firmly attached to the outer wall of the inner tank and a second surface firmly attached to the inner wall of the outer tank and with the passageway defined by the spaces between the individual spacer members.

In another embodiment of the present invention, the spacer means is defined by sheets of plastic or the like with each sheet having a first face firmly attached to the outer wall of the inner tank and having a second face firmly attached to the inner wall of the outer tank and with the passageway defined by grooves or channels cut into the first face of the sheets.

BRIEF DESCRIPTION OF THE DRAWINGS

FIG. 8A is a sectional view of one of the spacer members.

DESCRIPTION OF THE PREFERRED EMBODIMENT

The underground liquid storage tank assembly of the present invention is primarily for use in storing a large quantity of liquid for subsequent use. For example, the assembly is especially adapted for use in gasoline service stations to store a quantity such as 10,000 gallons of gasoline. The assembly comprises, in general, an inner or primary tank for holding and storing the quantity of liquid; an outer tank for completely enclosing the inner tank; and spacer means for being positioned between and securely joining the inner and outer tanks and for defining passageways between the inner and outer tanks to allow any leakage of fluid from the inner tank to pass therethrough.

Figure 1:
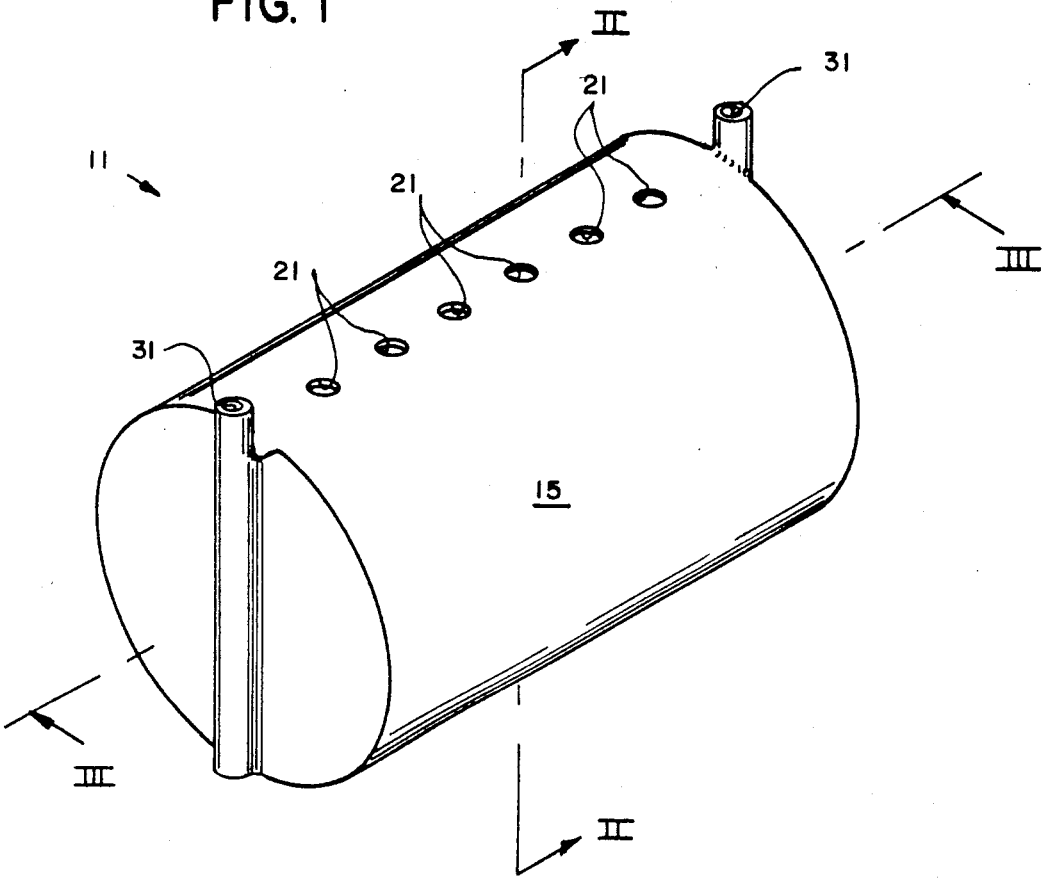
FIG. 1 is a perspective view of a first embodiment of the underground liquid storage tank assembly of the present invention.
Figure 2:
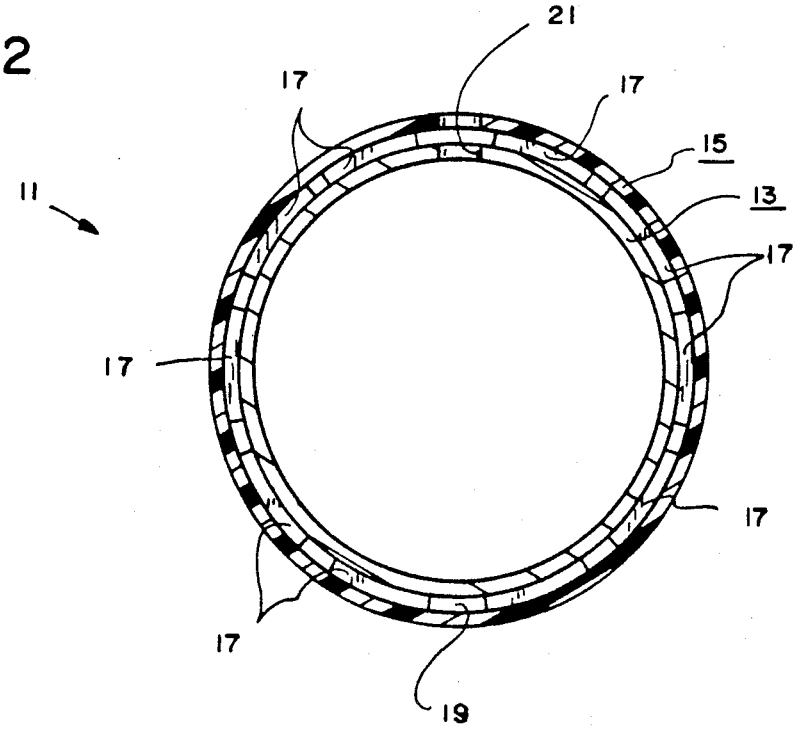
FIG. 2 is a sectional view substantially as taken on line II—II of FIG. 1.
Figure 3:
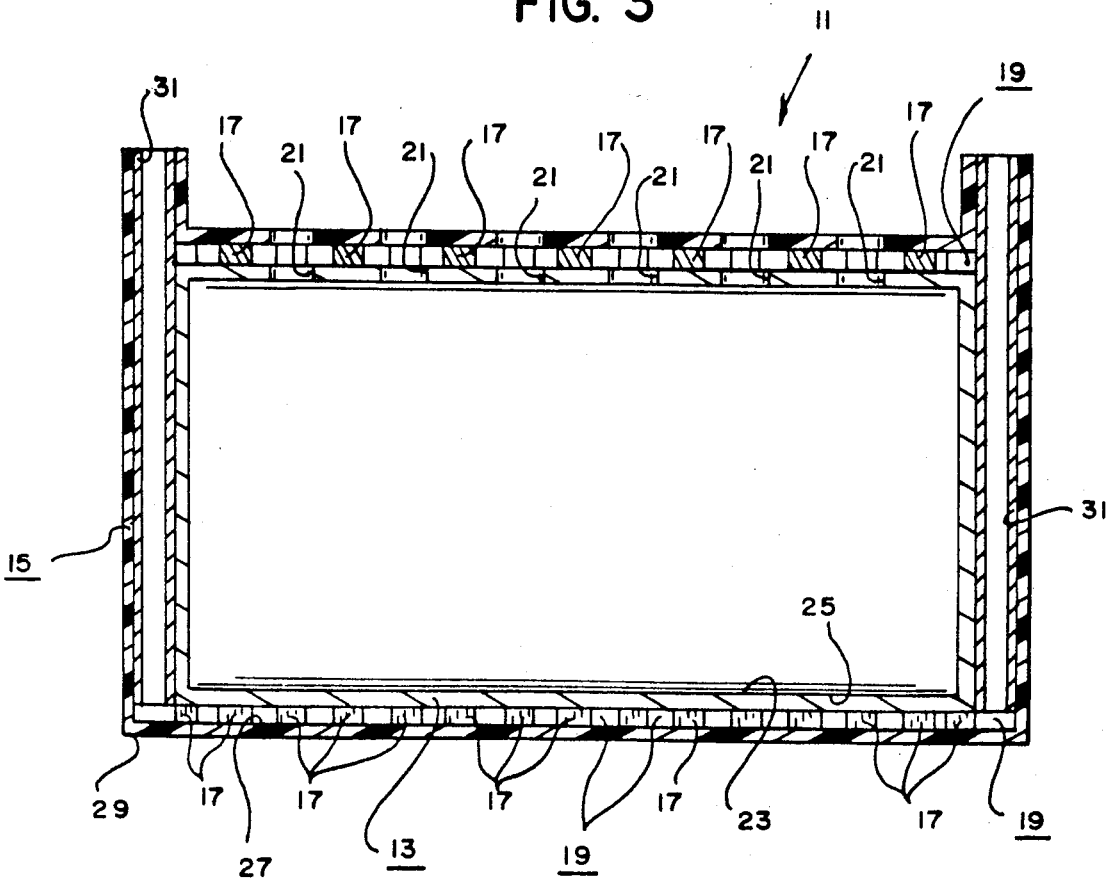
FIG. 3 is a sectional view substantially as taken on line III—III of FIG. 1.
Figure 4:
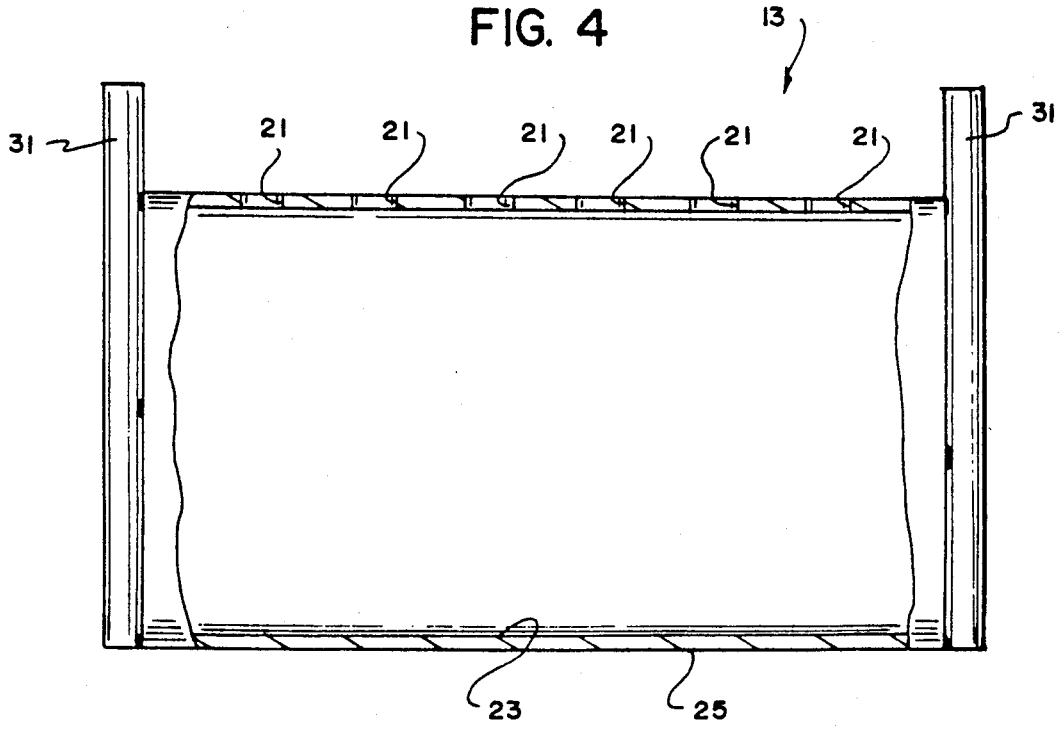
FIG. 4 is a side elevational view of an inner or primary tank of the assembly of FIG. 1 with a portion thereof broken away.

A first embodiment of the assembly of the present invention is shown in FIGS. 1–13 and the assembly is identified by the numeral 11 (see, in general, FIGS. 1–3) with the inner or primary tank identified by the numeral 13, the outer tank identified by the numeral 15, the spacer means including a plurality of spacer members identified by the numeral 17, and the passageways identified by the numeral 19 and defined by the spaces between adjacent spacer members 17.

The inner or primary storage tank 13 (see, in general, FIGS. 4–6) is of typical steel construction well known to those skilled in the art. The tank 13 is provided with the standard tank openings 21 for allowing the tank 13 to be filled with fluid and for allowing the fluid to be selectively pumped from the tank, etc. The tank 13 is typically of a hollow cylindrical shape having an inner wall or surface 23 for defining a cavity to hold the liquid and having an outer wall or surface 25. As an optional feature, the bottom of the interior surface 23 of the tank 13 may be coated with a corrosion resistant plastic or the like (not shown) to prevent or reduce internal corrosion of the tank 13.

The outer tank 15 (see, in general, FIGS. 1–3 and 11–13) is preferably constructed of a corrosion resistant material such as fiberglass reinforced plastic. An excellent material is that which is now used by the fiberglass tank manufacturers. The outer tank 15 also preferably has a substantially cylindrical shape with an inner wall or surface 27 for defining a cavity that completely envelopes the inner tank 13, and having an outer surface 29. One unique feature of the present invention is that the outer surface 29 of the outer tank 15 is seamless, similar to the standard fiberglass tanks now in common use, with no seams or heat-welded joints as now used in the so-called "tank-in-bag" systems. The outer tank 15 is preferably of the same general quality and thickness as the fiberglass tanks now being produced. Each end of the outer tank 15 preferably has means for receiving monitoring sensors for detecting the presence of fluid within the passageways 19. Thus, for example, each end of the assembly 11 may be provided with a vertical pipe member 31 extending upward from the bottom of the passageways 19. More specifically, the pipe members 31 may be welded in a vertical position to opposite ends of the inner tank 13. The pipe members 31 may have a 2 inch (50.8 millimeters) diameter interior for accommodating well known monitoring sensors such as the Mallory Pollulert system of the Mallory Corp. of Indianapolis, Ind. or the Leak-X system of the Leak-X Corp. of Toronto, Ontario, Canada. The outer tank 15 may have an air vent means (not shown) therein for allowing air to escape the passageways 19. The air vent may consist merely of a vent pipe attached to the outer tank 15 and opening into the interior thereof adjacent one or more passageways 19.

Each of the spacer members 17 (see, in general, FIGS. 2, 3 and 7–10) has an inner surface 32 for being securely fastened or attached to the outer surface 25 of the inner or primary tank 13 and has an outer surface 33 for being securely fastened or attached to the inner surface 27 of the outer tank 15. The spacer members 17 may be constructed of molded plastic, extruded plastic or strips of such materials such as fiberglass reinforced plastic (the same basic material as commonly used in fiberglass tanks). Each spacer member 17 may be securely and rigidly attached to the inner and outer tanks 13, 15 with any suitable adhesive well known to those skilled in the art.

Figure 5:
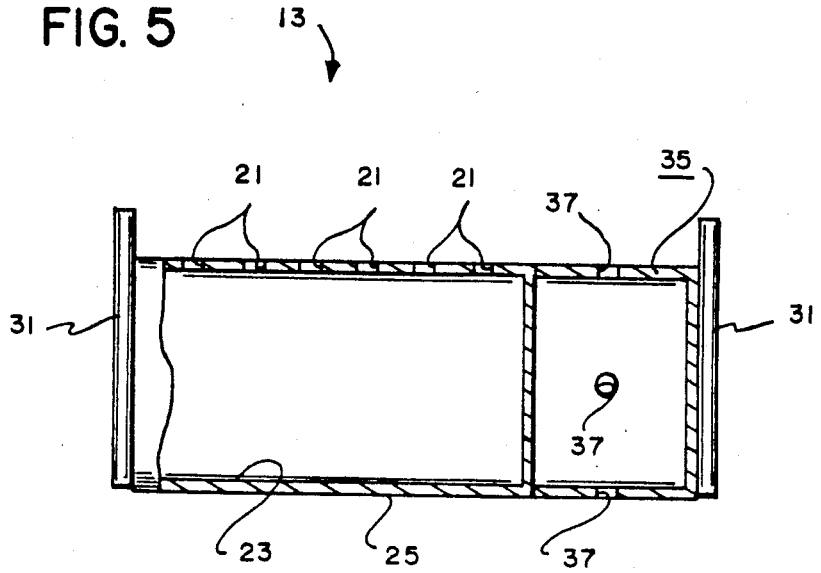
FIG. 5 is a view similar to FIG. 4 but showing a first embodiment of an auxiliary compartment or tank attached thereto.
Figure 6:
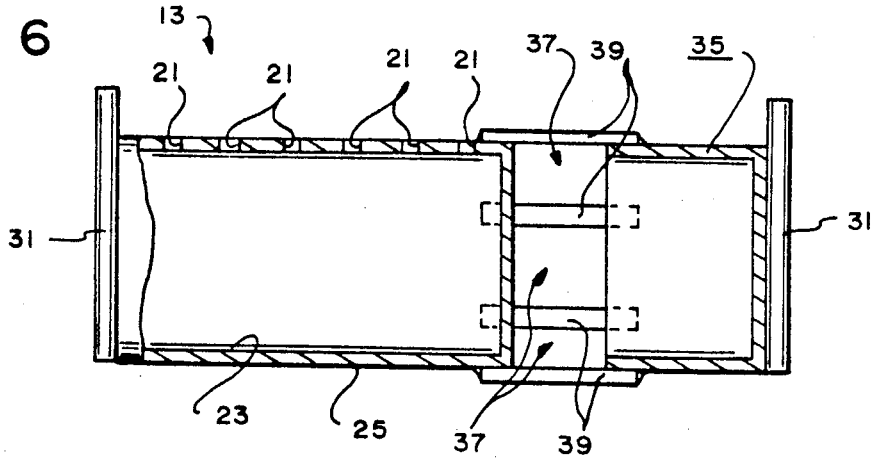
FIG. 6 is a view similar to FIG. 4 but showing a second embodiment of an auxiliary compartment or tank attached thereto.
Figure 7:
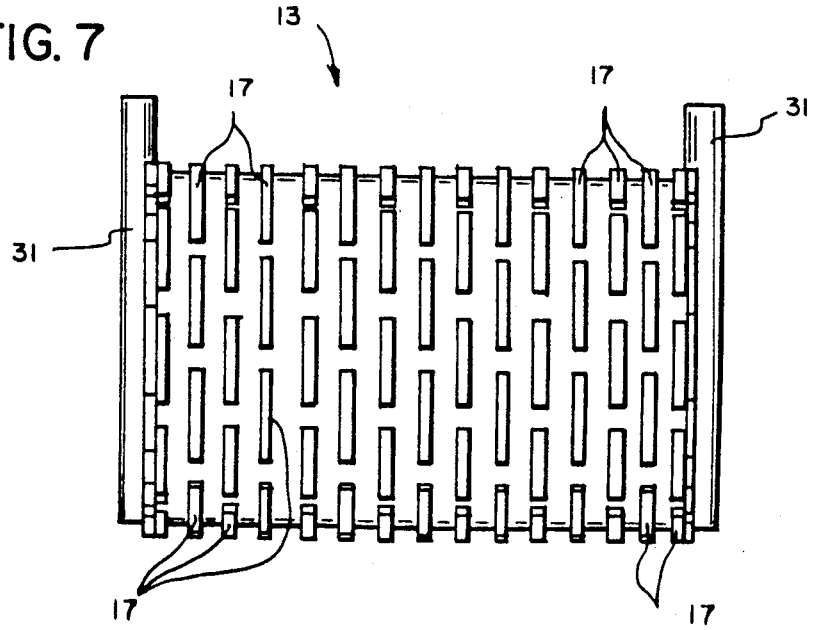
FIG. 7 is a side elevational view of the inner or primary tank of the assembly of FIG. 1 with a plurality of the spacer members attached thereto.
Figure 8:
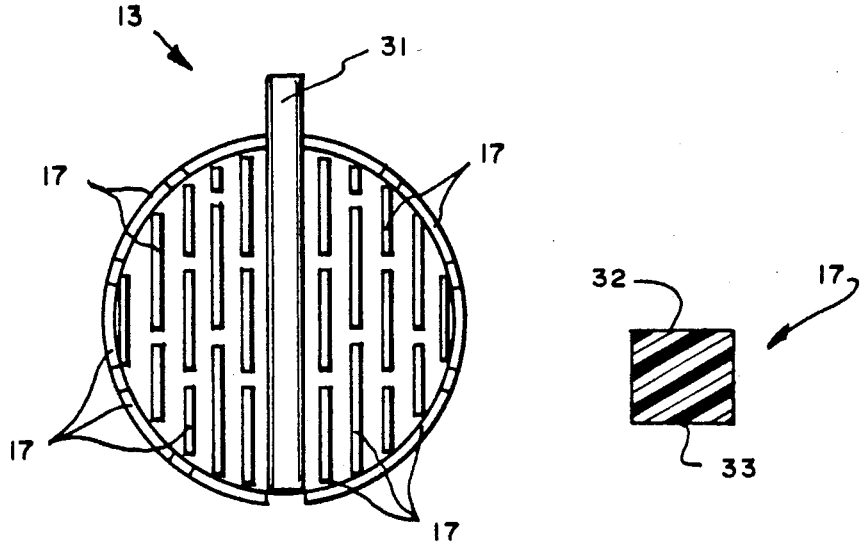
FIG. 8 is an end elevational view of FIG. 7.
Figure 9:
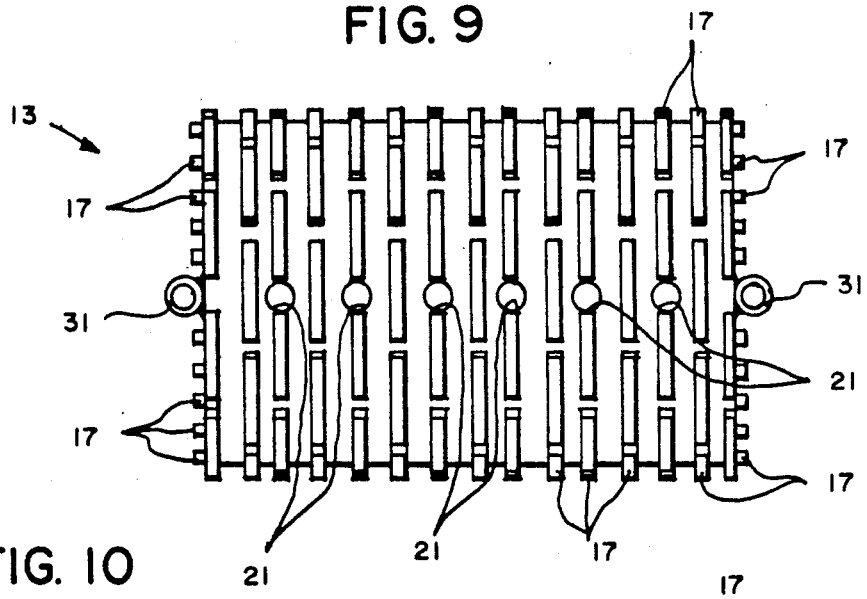
FIG. 9 is a top plan view of FIG. 7.
Figure 10:
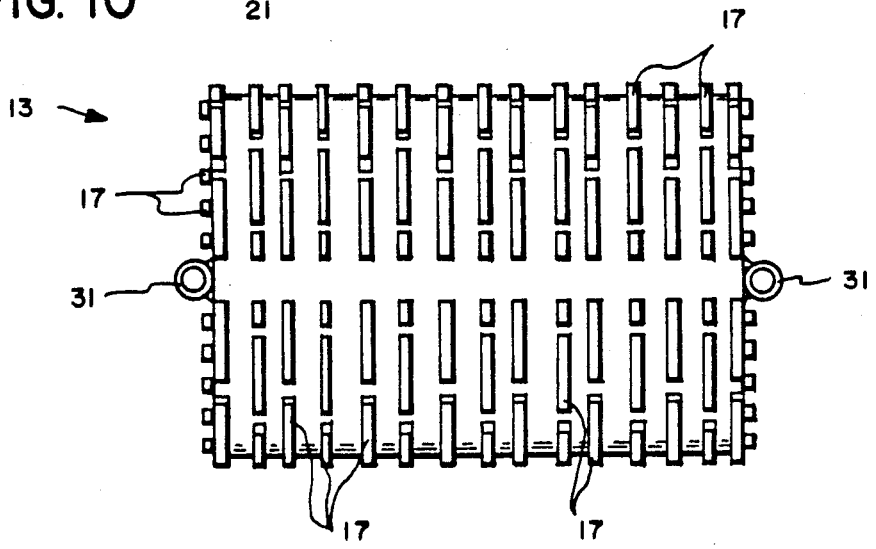
FIG. 10 is a bottom plan view of FIG. 7.
Figure 11:
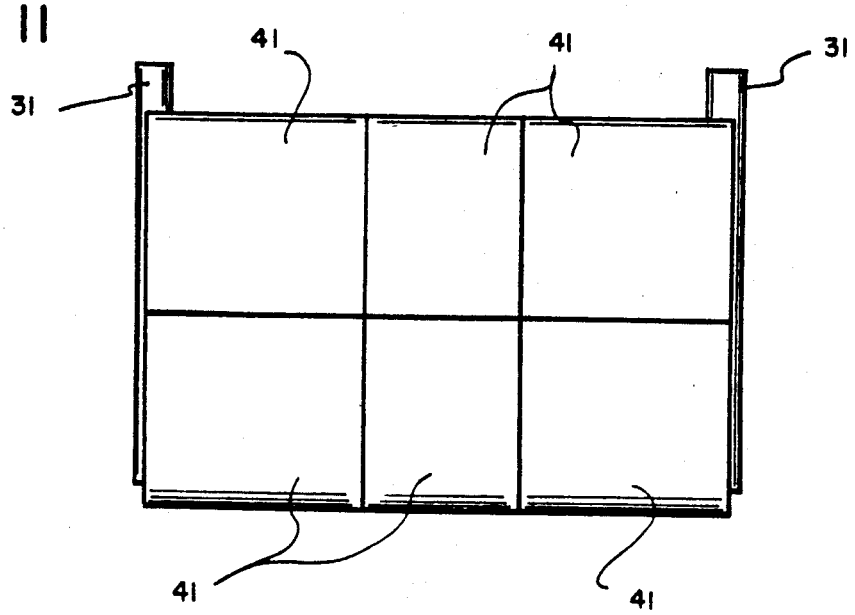
FIG. 11 is a side elevational view similar to FIG. 7 but showing thin sheets of fiberglass reinforced plastic attached to the spacer members and forming a first or inner layer of an outer or containment tank of the assembly.
Figure 12:
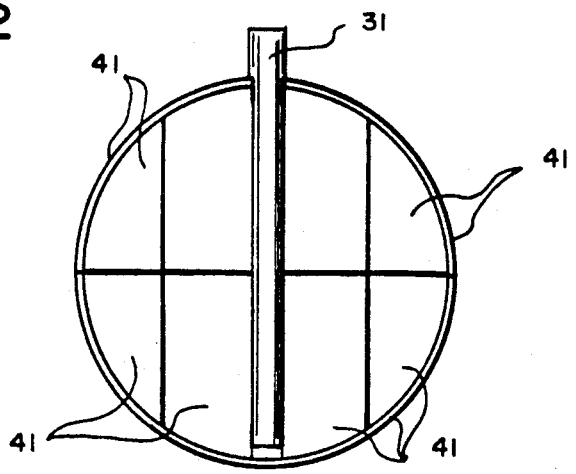
FIG. 12 is an end elevational view of FIG. 11.
Figure 13:
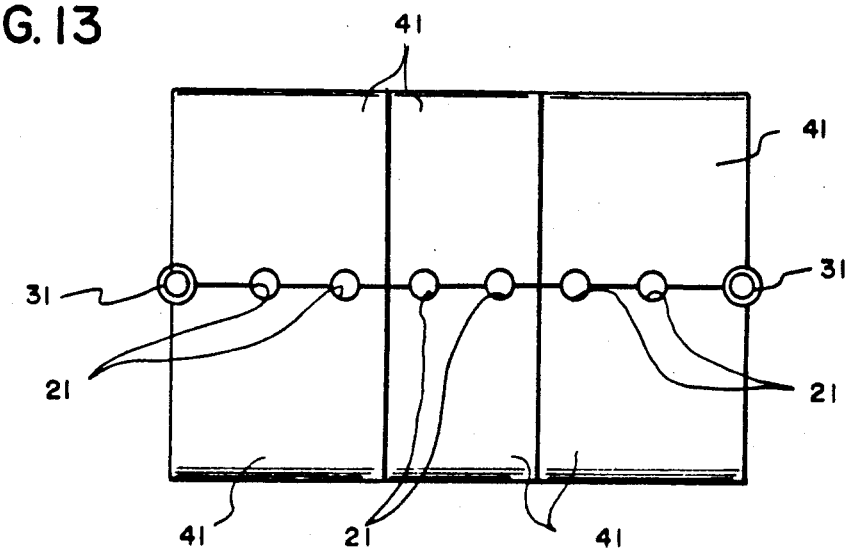
FIG. 13 is a top plan view of FIG. 11.
Figure 14:
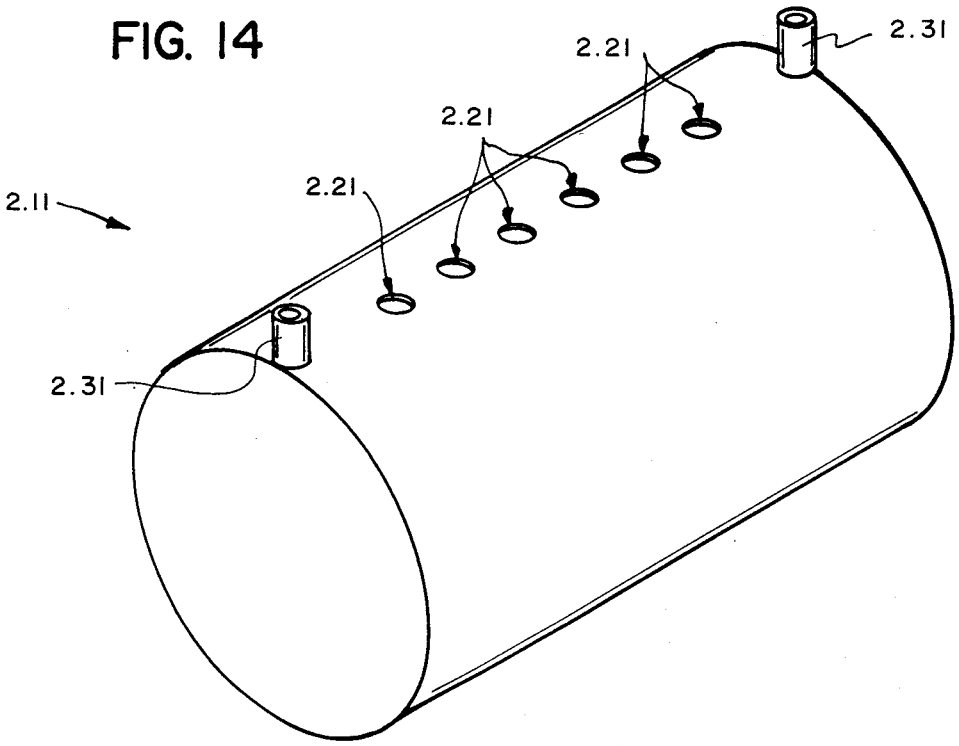
FIG. 14 is a perspective view of a second embodiment of the underground liquid storage tank assembly of the present invention.
Figure 15:
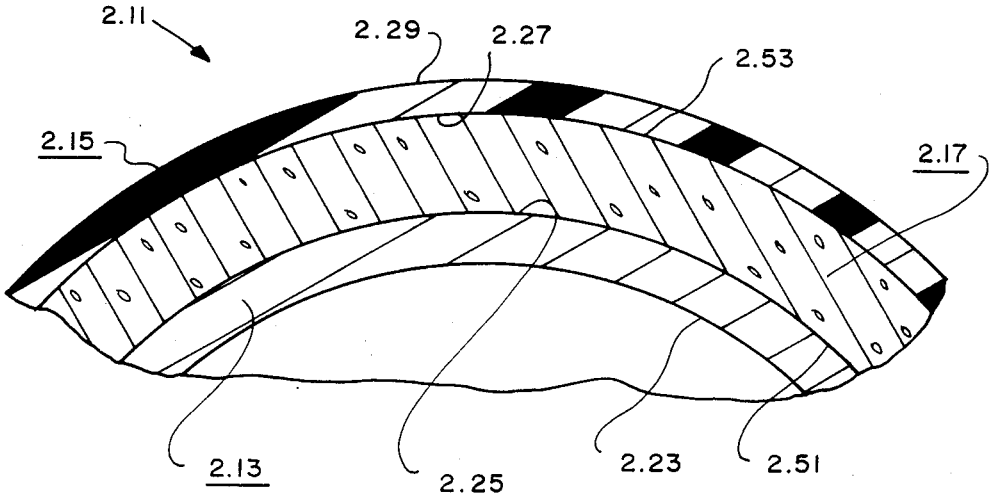
FIGS. 15 and 16 are enlarged sectional views of portions of the assembly of FIG. 14.
Figure 16:
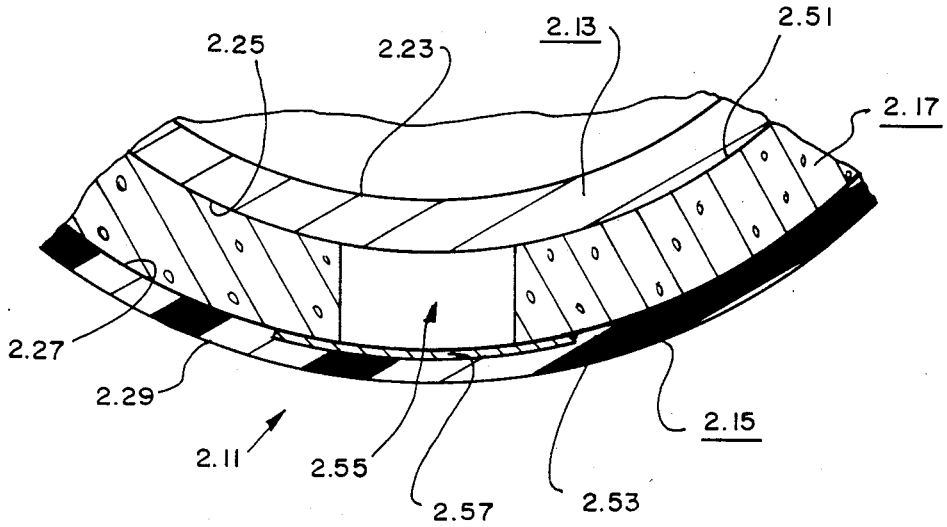
Figure 17:
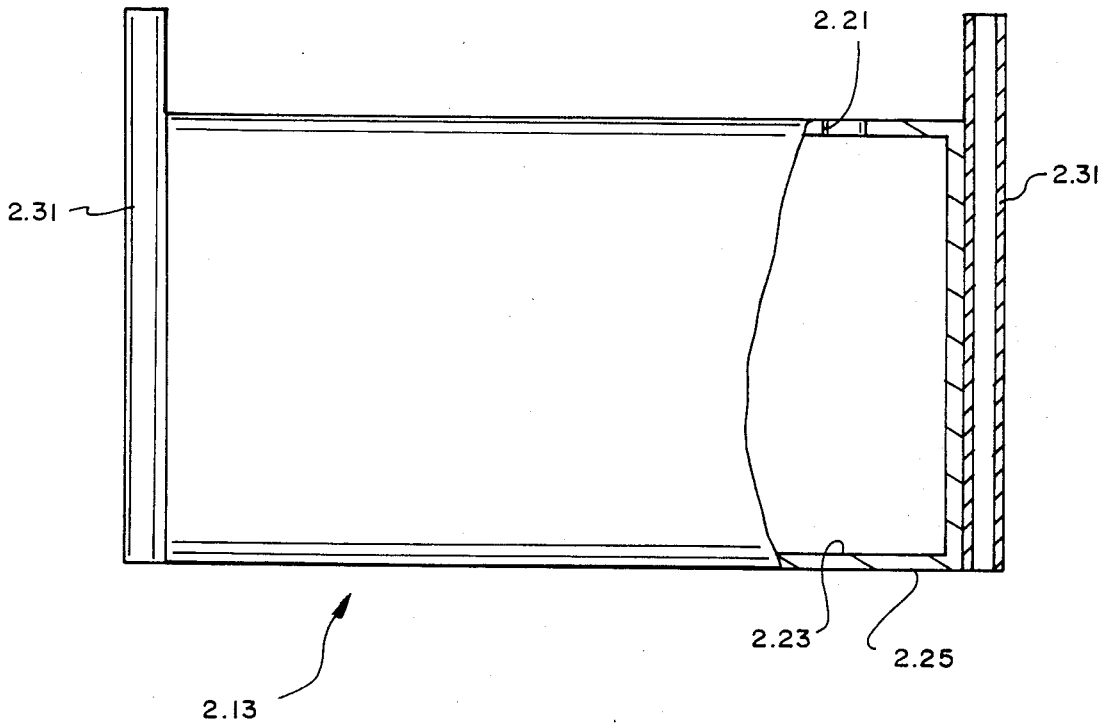
FIG. 17 is a side elevational view of an inner or primary tank of the assembly of FIG. 14 with a portion thereof broken away.

The assembly 11 may include an auxiliary or secondary tank 35 (see, in general, FIGS. 5 and 6) positioned within the outer tank 15 and fixedly attached to the inner and outer tank 13, 15 to form a rigid, integral structure therewith. The auxiliary tank 35 defines a means for increasing the volume of the outer tank 15 (i.e., the leak retention shell) while still maintaining the strength, structural integrity and economy of the assembly 11. Some government agencies require that the secondary containment means have a volume twenty percent greater than primary or basic storage vessel. This objective can be accomplished by merely making the diameters of the interior and exterior containment members (i.e., the inner and outer tank 13, 15) in the proper proportions. Thus, an outer tank 15 having a 105.24 inch (2.67 meters) diameter has a twenty percent greater volume than an inner tank having a ninety-six inch (2.44 meters) diameter. However, such a structure would require a radial distance between the inner and outer tank of 4.62 inches (117.35 millimeters): such a large gap would reduce the rigidity and strength of the total assembly unless additional and costly structural components were added to the intermediate supporting spacer members. The unique solution of the present invention is to extend the basic or primary inner storage tank structure and partition it off for the desired auxiliary storage capacity, leaving the additional unused inner structure to handle the extra leakage capacity. One example is shown in FIG. 5 in which a 10,000 gallon basic steel inner or primary storage tank 13 is illustrated with an additional 2,000 gallon auxiliary compartment or tank 35 welded to one end thereof. Ingress of any leakage from the primary tank 13 to the auxiliary tank 35 is provided by a plurality of openings 37 provided in the auxiliary tank 35. Another example is shown in FIG. 6 in which the additional 2,000 gallon steel auxiliary tank 35 is spaced a short distance from the primary tank 13 and fixedly attached thereto by means of steel plates 39 welded and spaced evenly about the periphery thereof and coacting to define the openings 37. In either case, the spacer members 17 would be applied over the outer surface of the auxiliary tank 35 in addition to the outer surface 25 of the inner tank 13 whereby the inner or primary tank 13, auxiliary tank 35 and outer tank 15 are joined to one another by the spacer members 17 to form a rigid, integral unit.

The specific construction of the assembly 11 may vary as will be apparent to those skilled in the art. Thus, the inner or primary tank 13 may be constructed of steel in the same manner now commonly used to construct typical underground steel storage tanks. The spacer members 17 can be molded out of plastic and securely fastened or attached to the outer surfaces of the inner and auxiliary tanks 13, 15 as shown. One method of applying and constructing the outer tank 15 is to lay thin sheets 41 of fiberglass reinforced plastic or the like (see, in general, FIGS. 11–13) over the spacer members 17 and to fasten the sheets 41 to the outer surfaces of the spacer members 17 using a suitable adhesive well known to those skilled in the art. The joints between the sheets of fiberglass reinforced plastic can then be sealed with any suitable and compatible adhesive tape well known to those skilled in the art. The sheets 41 thus form a first or inner layer of the outer tank 15. The final step is to apply the outer surface 29 of the outer tank 15. The most satisfactory method as used by fiberglass tank manufacturers, is to actually spray on the material which consists of a resin and chopped fiberglass. This sprayed on material thus forms a second or outer layer of the outer tank 15. It is an important feature of the present invention that the spacer members 17, the thin sheets of fiberglass or the like which is adhered to the spacer members 17, and the final outer surface material forming the outer tank 15 are all chemically and physically compatible with one another to form a rigid, integral unit. The end result is a strong, sturdy assembly with no seems or joints in the outer surface 29 of the outer tank 15. Separate testing of the inner and outer tanks 13, 15 can be conducted at the time of manufacture, at the time of installation and after the system has been installed and has been in use.

A second embodiment of the assembly of the present invention is shown in FIGS. 14–22 and the assembly is identified by the numeral 2.11 (see, in general, FIGS. 14–16) with the inner or primary tank identified by the numeral 2.13, the outer tank identified by the numeral 2.15, the spacer means including a plurality of spacer sheets or plates identified by the numeral 2.17, and the passageways identified by the numeral 2.19.

The inner or primary storage tank 2.13 (see, in general, FIG. 17) may be of typical steel construction well known to those skilled in the art and is preferably substantially identical to the tank 13. Thus, the tank 2.13 is preferably provided with the standard tank openings 2.21 for allowing the tank 2.13 to be filled with fluid and for allowing the fluid to be selectively pumped from the tank, etc. The tank 2.13 is typically of a hollow cylindrical shape having an inner wall or surface 2.23 for defining a cavity to hold the liquid and having an outer wall or surface 2.25. As an optional feature, the bottom of the interior surface 2.23 of the tank 2.13 may be coated with a corrosion resistant plastic or the like (not shown) to prevent or reduce internal corrosion of the tank 2.13.

The outer tank 2.15 (see, in general, FIGS. 15 and 16) is preferably constructed of a corrosion resistant material such as fiberglass reinforced plastic. An excellent material is that which is now used by the fiberglass tank manufacturers. The outer tank 2.15 also preferably has a substantially cylindrical shape with an inner wall or surface 2.27 for defining a cavity that completely envelopes the inner tank 2.13, and having an outer wall or surface 2.29. One unique feature of the present invention is that the outer surface 2.29 of the outer tank 2.15 is seamless, similar to the standard fiberglass tanks now in common use, with no seams or heat-welded joints as now used in the so-called "tank-in-bag" systems. Preferably, the outer tank 2.15 is formed by merely spraying a layer of fiberglass reinforced plastic or the like directly onto the spacer sheets 2.17 in a manner as will now be apparent to those skilled in the art. Each end of the outer tank 2.15 preferably has means for receiving monitoring sensors for detecting the presence of fluid within the passageways 2.19. Thus, for example, each end of the assembly 2.11 may be provided with a vertical pipe member 2.31 extending upward from the lowermost portion of the inner tank 2.13 (see, in general, FIG. 17). More specifically, the pipe members 2.31 may be welded in a vertical position to opposite ends of the inner tank 2.13. The pipe members 2.31 may have a 2 inch (50.8 millimeters) diameter interior for accommodating well known monitoring sensors such as the Mallory Pollulert system of the Mallory Corp. of Indianapolis, Ind. of the Leak-X system of the Leak-X Corp. of Toronto, Ontario, Canada. The outer tank 2.15 may have an air vent means (not shown) therein for allowing air to escape the passageways 2.19. The air vent may consist merely of a vent pipe attached to the outer tank 2.15 opening into the interior thereof and communicating with one or more passageways 2.19.

Figure 18:
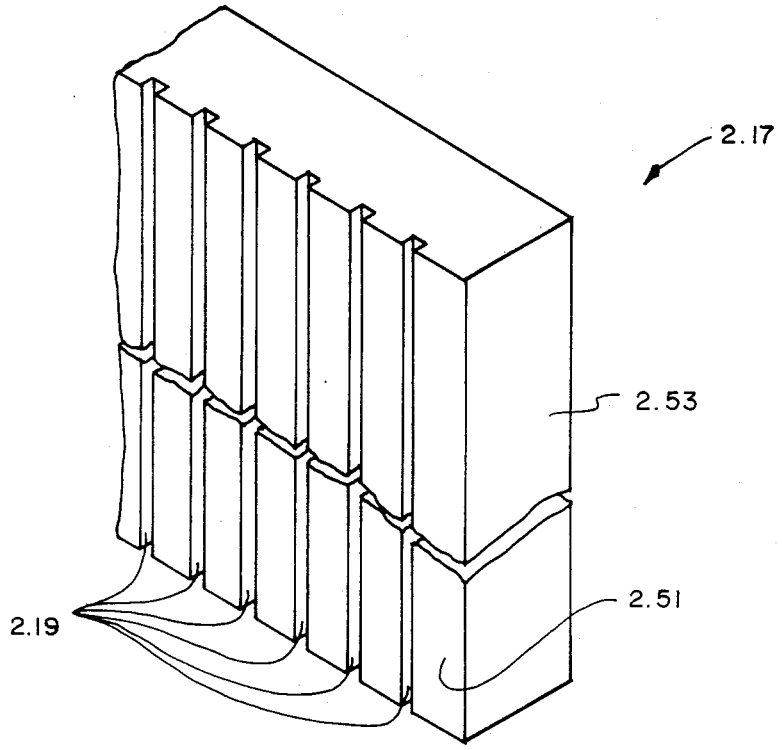
FIG. 18 is a perspective view of a spacer sheet or panel of the assembly of FIG. 14.
Figure 19:
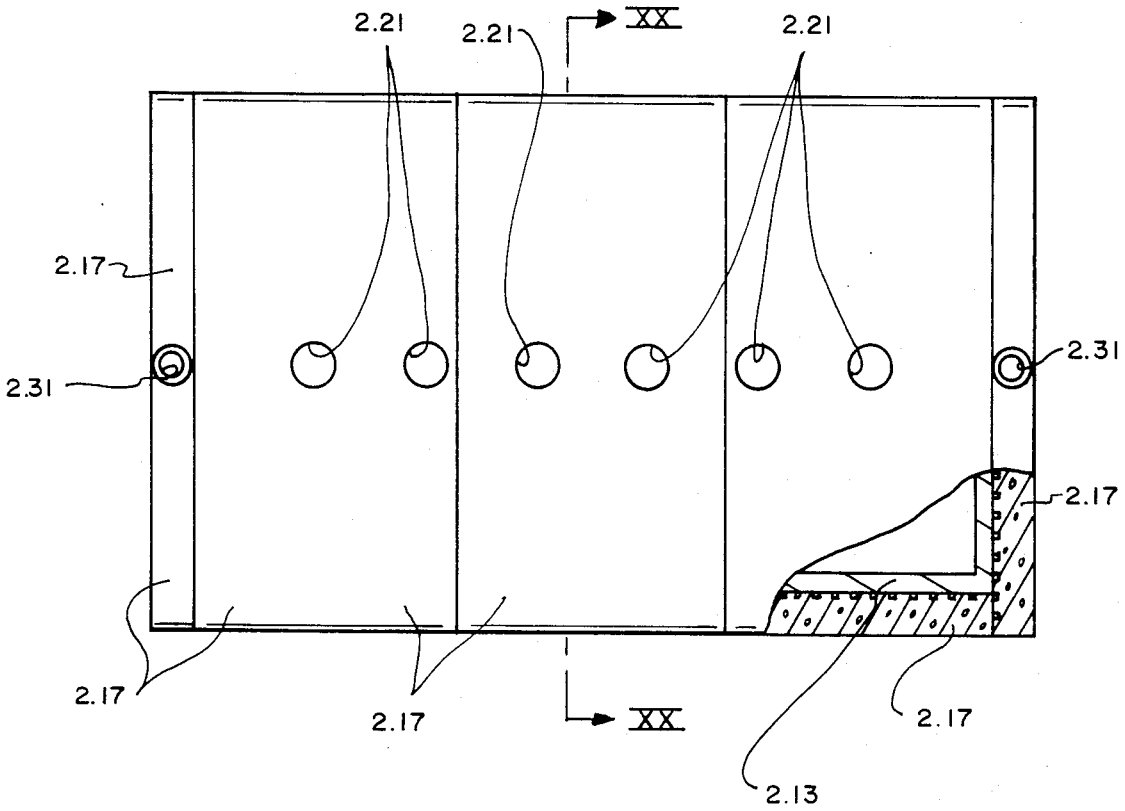
FIG. 19 is a top plan view of the inner or primary tank of FIG. 17 with the exterior surface thereof covered with the spacer sheets or panels of FIG. 18 and with a portion thereof broken away.
Figure 20:
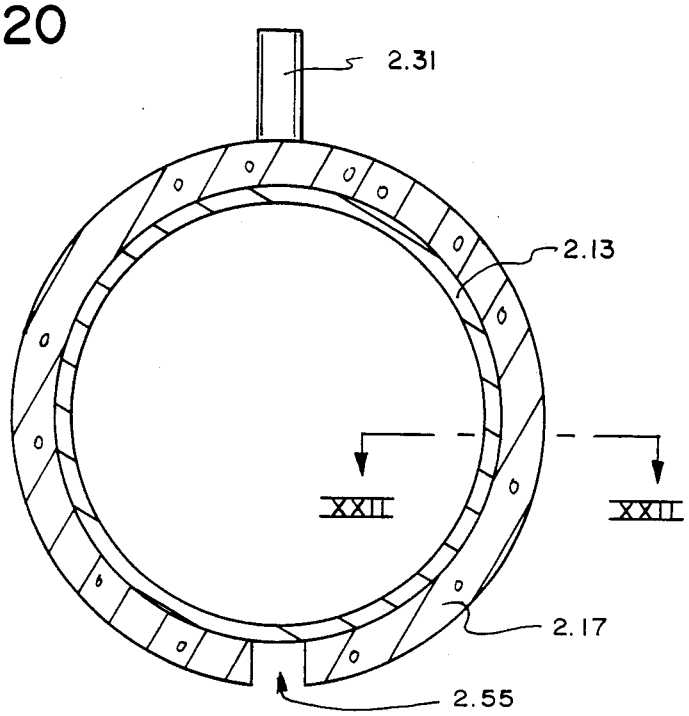
FIG. 20 is a sectional view substantially as taken on line XX—XX of FIG. 19.
Figure 21:
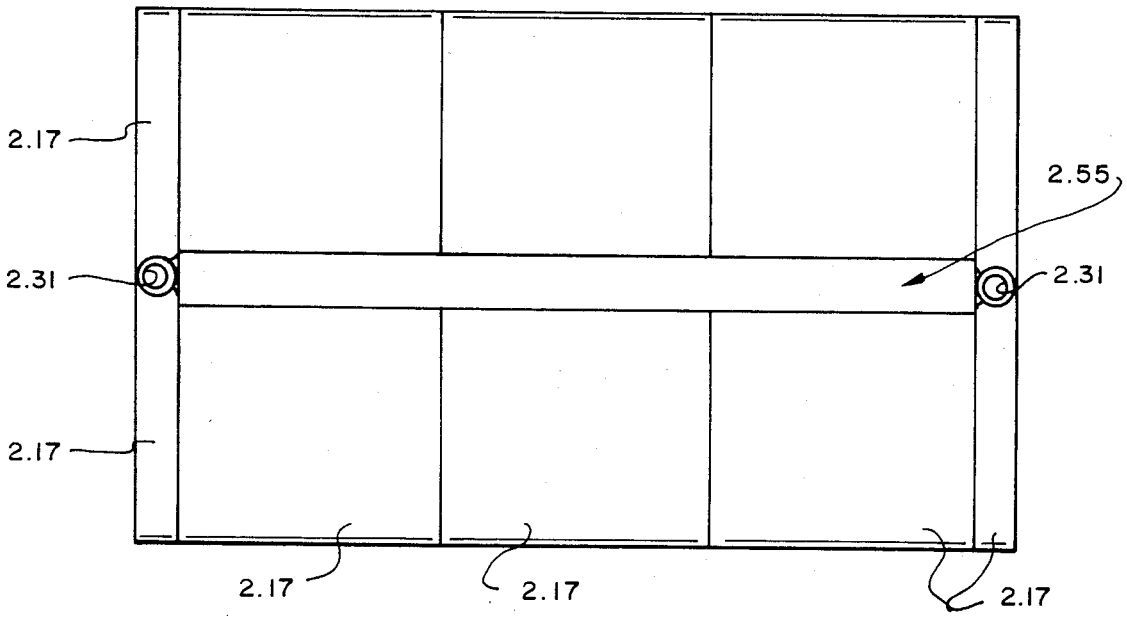
FIG. 21 is a bottom plan view of FIG. 19.
Figure 22:
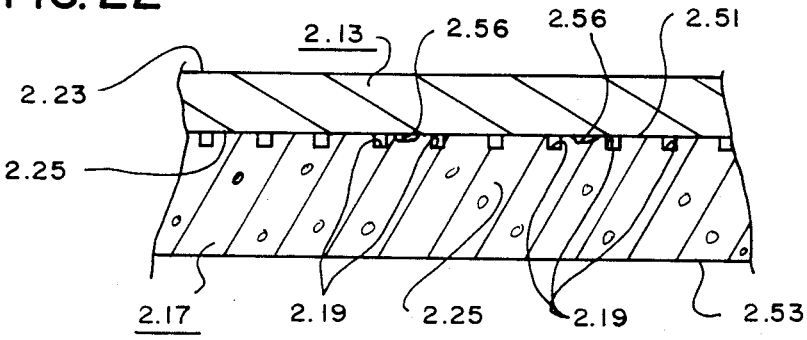
FIG. 22 is an enlarged sectional view of a portion of FIG. 19.

The spacer sheets or panels 2.17 preferably consist of complete sheets of easily applied plastic such as, e.g., 2 inch (50.8 millimeters) thick, 2 feet (0.6 meter) wide sheet or panel of polyurethane foam (see, in general, FIG. 18). Thus, each sheet 2.17 has a first side or face 2.51 for being attached to the outer surface 2.25 of the inner tank 2.13 and a second side or face 2.53 to which the inner wall or surface 2.27 of the outer tank 2.15 is attached. The first face 2.51 of each sheet 2.17 may be firmly attached to the outer surface 2.25 of the inner tank 2.13 by way of any typical adhesive or the like now apparent to those skilled in the art. The adhesive may be applied as a plurality of spots 2.56 between the inner tank 2.13 and each sheet 2.17 (see FIG. 22) to firmly and securely join the sheets 2.17 to the inner tank 2.13. The sheets 2.17 thus define a strong, continuous intermediate member that provides a continuous surface for receiving the outer tank 2.15.

The passageways 2.19 may be defined, in part at least, by grooves or channels provided in the first face 2.51 of each sheet 2.17. The channels may be formed in the sheets 2.17 in any manner now apparent to those skilled in the art. Thus, for example, a plurality of scores or cuts may be made in the first face 2.51 of each sheet 2.17 extending lengthwise of the sheet 2.17. Such channels may be, e.g., ¼ inch (6.36 millimeters) wide and ¼ inch (6.35 millimeters) deep on 1 inch (25.4 millimeters) centers. These flow channels carry any leakage from the inner tank 2.13 to the bottom of the tank 2.13. The passageways 2.19 preferably communicates with an opening or slot 2.55 in the sheets 2.17 located at the bottom of the inner tank 2.13 and extending the entire length of the inner tank 2.13. The opening or slot 2.55 may be 3 inches (76.2 millimeters) in width and 2 inches (50.8 millimeters) in depth (i.e., the entire thickness of the sheets 2.17). The opening or slot 2.55 allows any leakage from the inner tank 2.13 to migrate to the monitoring sensors in the pipe member 2.31 at either end of the assembly 2.11. The opening or slot 2.55 may be cut into the sheets 2.17 after the sheets 2.17 are attached to the inner tank 2.13 or the length of the sheets 2.17 may be such that the opening or slot 2.55 is formed naturally by the opposite ends of each sheet 2.17. When the opening or slot 2.55 extends completely through the sheets 2.17, a strip of material 2.57 such as fiberglass reinforced plastic cloth or the like is preferably attached to the sheets 2.17 to cover the opening or slot 2.55 before the outer tank 2.15 is applied thereto (see FIG. 16). The strip of material 2.57 allows the outer tank 2.15 to be merely sprayed onto the sheets 2.17 (as a layer of fiberglass reinforced plastic or the like) and thus helps to define the opening or slot 2.55.

The assembly 2.11 may include an auxiliary or secondary tank like the secondary tank 35 of the assembly 11 and positioned within the outer tank 2.15 and fixedly attached to the inner and outer tank 2.13, 2.15 to form a rigid, integral structure therewith. The auxiliary tank defines a means for increasing the volume of the outer tank 2.15 (i.e., the leak retention shell) while still maintaining the strength, structural integrity and economy of the assembly 2.11. Reference should be made to the above description of the secondary tank 35 of the assembly 11 for a more detailed and fuller understanding of the secondary tank of the assembly 2.11.

The specific construction of the assembly 2.11 may vary as will be apparent to those skilled in the art. The preferred method of construction of the assembly 2.11 is as follows:

(1) The inner tank 2.13 is constructed of steel any manner now used to construct typical underground steel storage tanks (e.g., by welding steel plates together to form a hollow tank).

(2) The sheets 2.17 are then glued or otherwise attached over the entire exterior surface (i.e., the outer surface 2.25) of the inner tank 2.13 including the end portions thereof to form a strong, continuous intermediate or spacer means. The vertical channels are formed in the first face 2.51 of each sheet 2.17 prior to the sheets 2.17 being attached to the inner tank 2.13. The abutting edges of each sheet 2.17 are preferably sealed as the sheets 2.17 are applied to the inner tank 2.13 in any typical manner such as a layer of adhesive being applied to the abutting edges. The sheets 2.17 are preferably sufficiently flexible to be bent around the outer surface 2.25 of the inner tank 2.13. Transverse, horizontal grooves (not shown) may be cut or otherwise provided in the sheets 2.17 to allow the sheets 2.17 to be more easily bent as will now be apparent to those skilled in the art. The opening or slot 2.55 is provided at the bottom of the inner tank/intermediate member unit either by cutting the slot 2.55 from the sheets 2.17 or applying the sheets 2.17 to the inner tank 2.13 so the opposite ends thereof are spaced apart from one another.

(3) The final exterior coating (i.e., the outer tank 2.15) can then be sprayed over the inner tank/intermediate member unit to thus form a completely rigid double wall tank assembly which allows the use of monitors to detect any leakage between the two walls. If the slot 2.55 extends completely through the intermediate member (i.e., the sheets 2.17), the strip of material 2.57 is applied over the slot 2.55 before the final exterior coating is sprayed over the inner tank/intermediate member unit.

Figure 23:
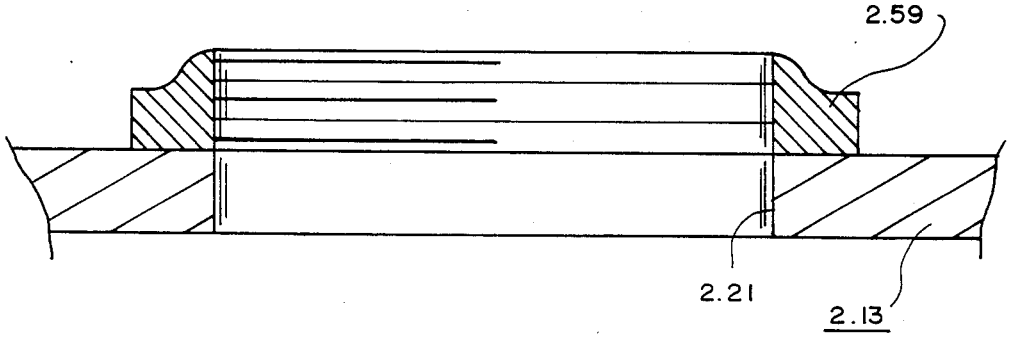
FIGS. 23 and 24 are enlarged sectional views of portions of the assembly showing modified construction of the inner tank.
Figure 24:
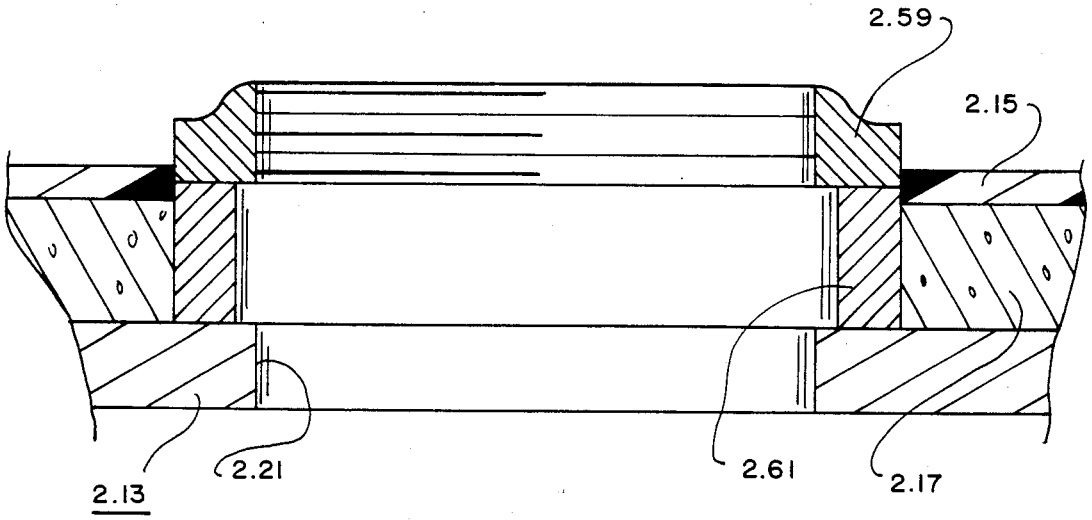

Modified constructions of a portion of the inner tank 2.13 are shown in FIGS. 23 and 24. More specifically, FIG. 23 shows a typical threaded flange 2.59 welded to the tank 2.13 conterminous with an opening 2.21. FIG. 24 shows a ring-like spacer flange 2.61 positioned between the threaded flange 2.59 and the body of the tank 2.13 to accommodate the spacer means and outer tank 2.15 as will now be apparent to those skilled in the art. The spacer flange 2.61 is attached at one end to the tank 2.13 about a passageway 2.21 and is attached at the other end to the threaded flange 2.59.

Although the present invention has been described and illustrated with respect to a preferred embodiment thereof and a preferred use therefore, it is not to be so limited since changes and modifications can be made therein which are within the full intended scope of the invention. The specific materials mentioned above do not exclude the use of other materials which would serve the same purpose and function.

I claim:

1. Underground liquid storage tank assembly comprising, in combination:

(a) an inner tank having an outer surface;

(b) an outer tank having an inner surface; and (c) spacer means positioned between and securely joining said inner and outer tanks, said spacer means having a first surface for being ridigly attached to said outer surface of said inner tank and having a second surface for being rigidly attached to said inner surface of said outer tank, said spacer means having a plurality of spaced apart, parallel channels in said first surface thereof for allowing any leakage of fluid from said inner tank to pass therethrough, said channels covering no more than 75% of said first surface of spacer means with at least 25% of said outer surface of said inner tank being rigidly secured directly to said first surface of said spacer means and with at least 25% of said inner surface of said outer tank being rigidly secured directly to said second surface of said spacer means for joining said inner tank and said outer tank thereto as a rigid combination.

2. The assembly of claim 1 in which said outer tank is seamless.

3. The assembly of claim 1 in which said spacer means includes a plurality of substantially rigid panels of plastic foam, each of said panels having an inner surface for being securely fastened to the outer surface of said inner tank and having an outer surface for being securely fastened to the inner surface of said outer tank.

4. The assembly of claim 3 in which each end of said outer tank has means for receiving monitoring sensors for detecting the presence of fluid within said channels.

5. The assembly of claim 4 in which said outer tank has an air vent means therein for allowing air to escape said channels.

6. The assembly of claim 1 in which is included an auxiliary tank positioned within said outer tank and fixedly attached to said inner tank and said outer tank.

7. Underground liquid storage tank assembly comprising in combination:

(a) a metal primary tank for storing a quantity of liquid;

(b) a metal secondary tank fixedly and rigidly attached to said primary tank and having a capacity of approximately 20 percent of the capacity of said primary tank;

(c) a fiberglass reinforced plastic outer tank for completely enclosing said primary and secondary tanks; and (d) a layer of plastic foam for being positioned between and securely and rigidly joining said primary and secondary tansk and said outer tank, said layer of plastic foam having a first side fixedly attached to the outer surface of said primary tank and said secondary tank, having a second side fixedly attached to the inner surface of said outer tank, having a slot extending therethrough at the lowest point thereof, and having a plurality of spaced apart, parallel channels in said first side thereof communicating with said slot for allowing any fluid that leaks from said primary tank to pass to said slot, each of said channels being arranged in a substantially vertical plane, said channels covering no more than 30% of said first surface of said layer of plastic foam with at least 70% of said outer surface of said inner tank being rigidly secured directly to said first surface of said layer of plastic foam and with at least 70% of said inner surface of said outer tank being rigidly secured directly to said second surface of said layer of plastic foam for joining said inner tank and said outer tank thereto as a rigid combination.

8. The assembly of claim 1 in which said inner tank has at least one opening therein for allowing said inner tank to be filled with fluid, and in which is included at least one spacer flange attached to said inner tank about said opening therein for accommodating said outer tank and said spacer means.

* * * * *